United States Patent [19]

Lapeyre

[11] 3,940,944

[45] Mar. 2, 1976

[54] AUTOMATIC GLASS WASHER AND CHILLER DISPENSER

[76] Inventor: James M. Lapeyre, 13 Richmond Place, New Orleans, La. 70115

[22] Filed: Oct. 17, 1974

[21] Appl. No.: 515,445

[52] U.S. Cl. ..... 62/322; 62/331; 62/374; 62/381; 134/63; 134/79; 134/170; 221/150 B

[51] Int. Cl.[2]... F25D 25/04; B08B 3/02; B08B 9/08

[58] Field of Search..... 134/48, 63, 78, 79–80, 134/142, 152, 153, 159, 166 R, 170–171; 221/150 HC, 150 B; 62/322, 331, 63, 381

[56] References Cited

UNITED STATES PATENTS

| | | | |
|---|---|---|---|
| 850,663 | 4/1907 | Lovell | 62/381 |
| 2,151,437 | 3/1939 | Ohme et al. | 134/80 X |
| 2,675,011 | 4/1954 | Maddaford | 134/79 |
| 2,739,455 | 3/1956 | Idzi | 221/150 B X |
| 2,953,144 | 9/1960 | Kapengst | 134/80 |
| 3,103,939 | 9/1963 | Haugland | 134/159 X |
| 3,302,655 | 2/1967 | Sasaki et al. | 134/79 |

*Primary Examiner*—Robert L. Bleutge
*Attorney, Agent, or Firm*—Wilkinson, Mawhinney & Theibault

[57] ABSTRACT

The present disclosure is directed to an automatic glass washer and chiller dispenser which pre-washes, immersion washes, hot rinses, cold rinses and chills cocktail and high ball glasses, including beer glasses and mugs on a ferris wheel type rotary transfer mechanism which moves dirty glasses through a wash, rinse and chill cycle in a compact cabinet structure for either bar use or service bar use.

5 Claims, 4 Drawing Figures

AUTOMATIC GLASS WASHER AND CHILLER DISPENSER

An object of the present invention is to provide a compact automatic glass washer, rinser and chiller for making chilled or frosted glasses immediately available to either a bartender or service bar operator.

A further object of the present invention is the provision of a continuous source of chilled glasses which have been washed, rinsed, and chilled ready for use in a lightweight, compact automatic apparatus requiring only a minimum of human attention.

A still further object of the present invention is the provision of an apparatus which pre-rinses, immersion washes, hot sprays and cold sprays glasses on a continuous basis prior to chilling and which has a storage reservoir of chilled glasses available for quick dispensing in bar service areas where chilled glasses are required in quantity.

With the foregoing and other objects in view the invention will be more fully described hereinafter and more particularly pointed out in the appended claims.

In the drawings in which like parts are denoted by reference characters throughout the several views.

Figure 1:
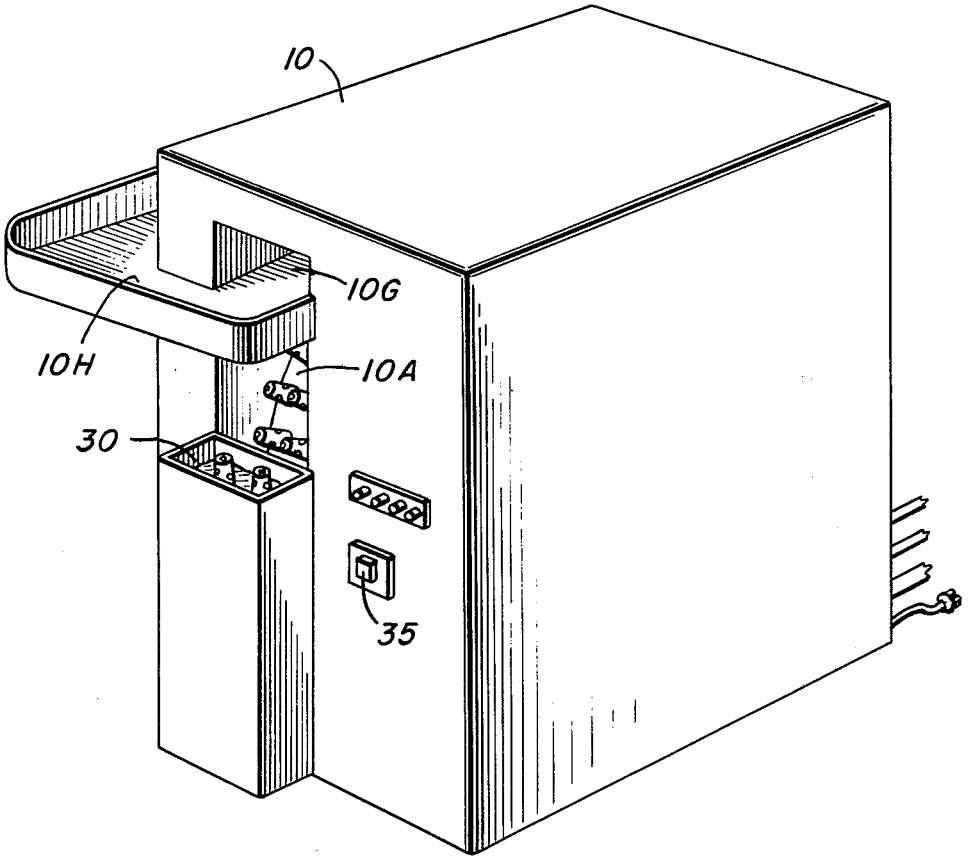
FIG. 1 is a perspective view of an automatic glass washer and chiller dispenser constructed in accordance with the present invention.
Figure 4:
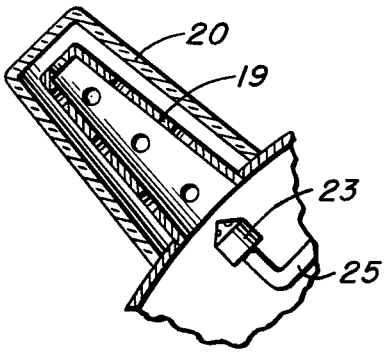
FIG. 4 is a sectional view taken through a glass supporting projection relative to a rinse spray taken at an enlarged scale.
Figure 2:
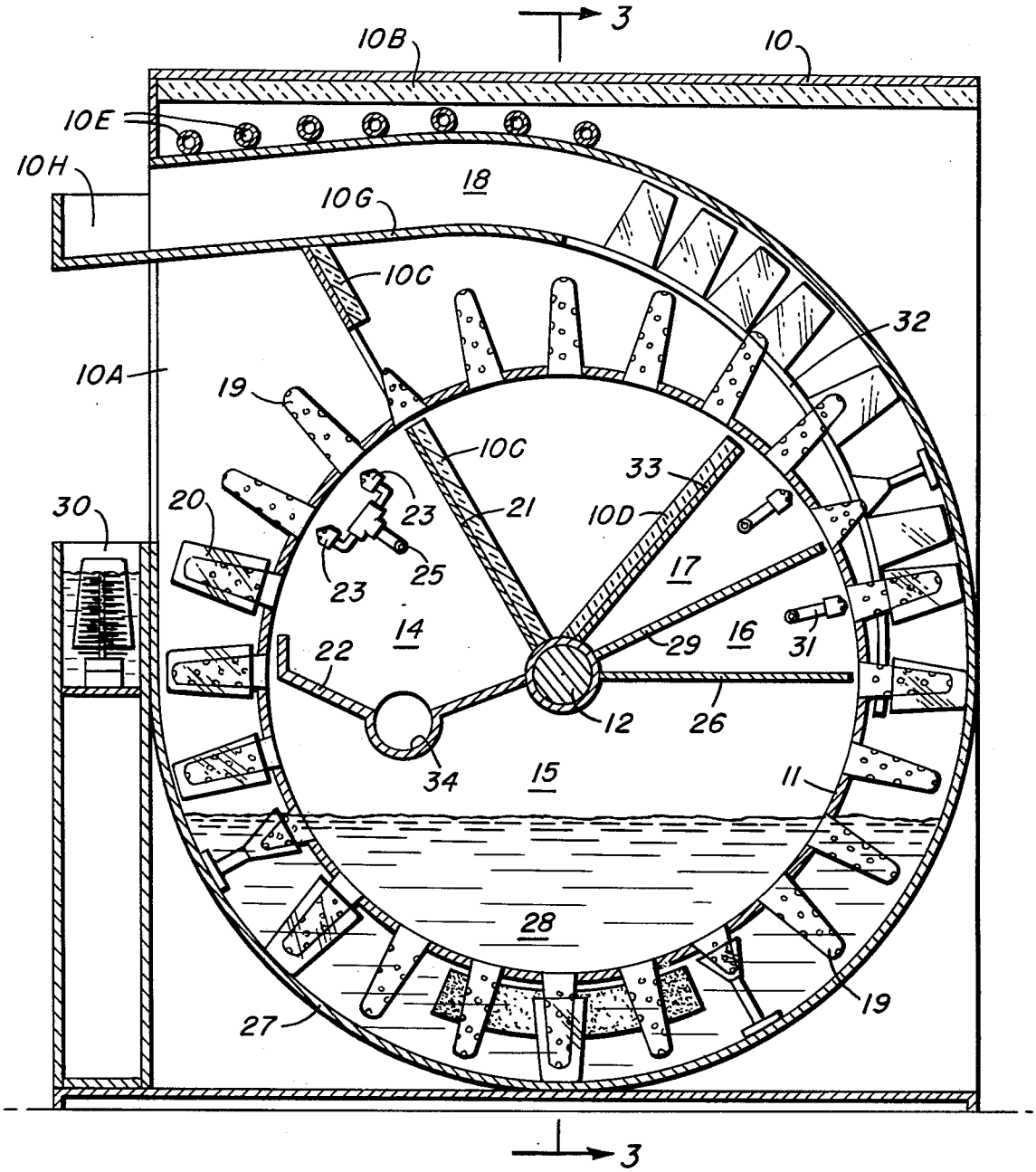
FIG. 2 is a vertical section taken through the apparatus of FIG. 1.

Referring now to the drawings, and for the moment to FIG. 2, 10 designates a cabinet structure in which is mounted a ferris wheel type rotary transfer device 11 which is driven by a shaft 12 powered by a motor 13. Arranged circumferentially about the device 12 are a pre-rinse zone 14, an immersion wash zone 15, a hot rinse zone 16, a cold rinse zone 17 and a chilling and cold storage area 18 to retain chilled glasses.

The ferris wheel transfer device is of a drum like structure from which extend radial projections 19 over which glasses 20 are placed in the inverted position. These projections are shaped generally of a truncated conical form and are foraminous to permit the wash and rinse water to pass to the interior of the glasses 20 placed thereover. Baffles 22,22 define the pre-rinse zone or compartment within which are mounted spray nozzles 23 supplied with pressurized detergent liquid from a pump 24 through lines 25. Between baffles 22 and 26 and an outer tank-like receptacle 27 is defined a wash immersion tank 28. Between baffles 26 and 29 is defined a hot rinse zone 16 having nozzles 31 connected to a pressurized hot water rinse line. The cold water rinse zone 17 lies between baffles 29 and 33.

The glasses 20 are manually pre-washed at 30 and introduced to the projections on the rotary transfer device through an opening 10A in cabinet 10.

The cabinet 10 is provided with insulating walls 10B, 10C and 10D to keep the chill area cold. Refrigeration coils 10E maintain chill temperature from refrigeration unit 10F.

The washed and chilled glasses 20 slide down a gravity slide 10G to a dispensing area 10H.

A vacuum connection 34 is provided to draw off cigarette butts, orange peels etc. left in glasses and loosened by the pre-rinse sprays 23. The projections 19 are of different shapes to accommodate both long stemmed cocktail glasses as well as high ball glasses.

Figure 3:
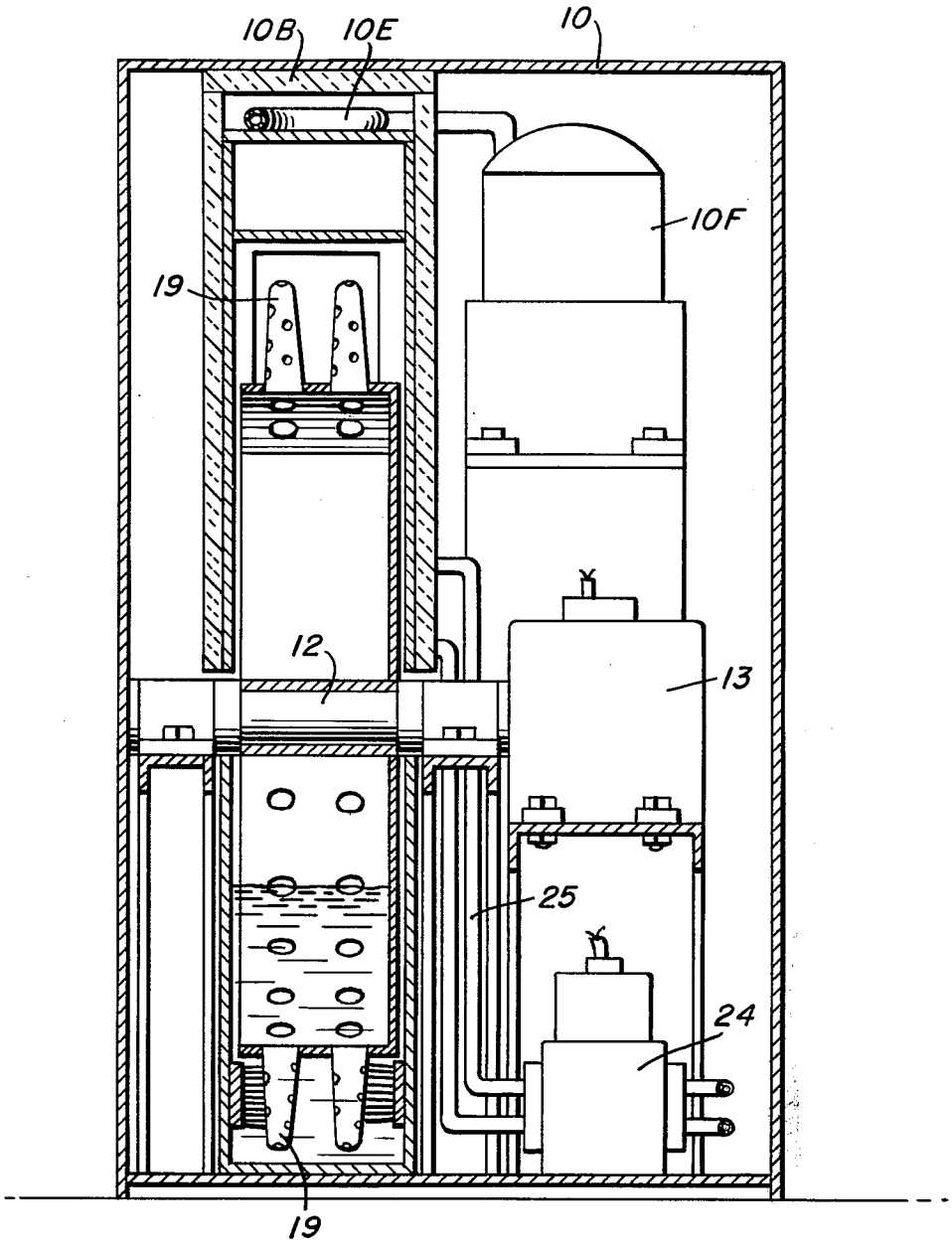
FIG. 3 is a transverse section taken on the lines 3—3 in FIG. 2.

In operation the bartender pushes button 35 which energizes motor 13 to commence rotation of the rotary transfer device while simultaneously activating all spray systems and the vacuum system. The refrigeration or chill system is operated independently so that glasses may be kept chilled when the washing system is not in operation. The width of the unit may accommodate 2, 3 or 4 glasses abreast, as shown in FIG. 3 depending upon the required capacity of chilled glasses required.

As the glasses 20 pass through the hot rinse zone 16 and cold rinse zone 17 they ride up a volutely curved plate 32 which is split to permit passage of the projections therethrough while urging the glasses 20 upwardly to the chill area 18 for their slide down the plate 10G.

What I claim is:

1. An automatic glass washer and chiller dispenser comprising
   a. wash means,
   b. rinse means,
   c. chilling means, and
   d. ferris wheel type rotary transfer means for advancing dirty glasses through said wash means and rinse means to said chilling means for subsequent dispensing while in a chilled state comprising a rotary drum means driven about a horizontal axis and having truncated perforated projections extending therefrom over which inverted glasses are placed.

2. An automatic glass washer as claimed in claim 1 wherein said wash means comprises a pre-rinse spray and an immersion wash.

3. An automatic glass washer as claimed in claim 1 wherein said rinse means comprises a hot spray rinse followed by a cold spray rinse in advance of said chilling means.

4. An automatic glass washer as claimed in claim 1 further comprising glass transfer means positioned to engage the glasses and remove same from the perforated projections for transfer to a chilled storage area.

5. An automatic glass washer as claimed in claim 4 wherein said glass transfer means is a split rail track bent on a volute curve to raise the glasses off the projections while permitting the projections to pass between the split in the rail.

* * * * *